US006530753B2

(12) United States Patent
Aramaki

(10) Patent No.: US 6,530,753 B2
(45) Date of Patent: Mar. 11, 2003

(54) SCREW COMPRESSOR WITH A FLUID CONTRACTING BYPASS

(75) Inventor: Kazuyoshi Aramaki, Kanagawa-ken (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/864,215

(22) Filed: May 25, 2001

(65) Prior Publication Data

US 2001/0048881 A1 Dec. 6, 2001

(30) Foreign Application Priority Data

May 29, 2000 (JP) ..... 2000-158467

(51) Int. Cl.[7] ..... F04B 49/00; F04B 23/00
(52) U.S. Cl. ..... 417/310; 417/440
(58) Field of Search ..... 417/310, 440, 417/441

(56) References Cited

U.S. PATENT DOCUMENTS 3,781,143 A * 12/1973 Wortman ..... 137/830
5,018,948 A * 5/1991 Sjte et al. ..... 417/302
5,127,386 A * 7/1992 Sowards ..... 123/564
5,265,636 A * 11/1993 Reed ..... 137/14
5,860,801 A * 1/1999 Timuska ..... 418/9
5,958,614 A * 9/1999 Takei et al. ..... 429/26
6,000,914 A * 12/1999 Eppli et al. ..... 417/300
6,062,827 A * 5/2000 Shu ..... 417/310

FOREIGN PATENT DOCUMENTS

JP 55-153615 * 11/1980 ..... B21B/45/02
JP 4-76285 * 3/1992 ..... F04C/18/02
JP 7-233730 9/1995

* cited by examiner

*Primary Examiner*—Charles G. Freay
*Assistant Examiner*—Timothy P. Solak
(74) *Attorney, Agent, or Firm*—Foley & Lardner

(57) ABSTRACT

A Lysholm compressor is provided with a rotor 5 in which a spiral tooth groove 5*a* is formed in order to form a tooth groove space 7, the rotor 5 taking-in and compressing a fluid in the tooth groove space 7, a discharge port 9 which discharges fluid which is compressed by the rotor 5, a bypass path 11 which communicates the discharge port 9 and the tooth groove space 7, and an outlet portion 13 of the bypass path which faces the discharge port 9. The outlet portion 13 has a pipe shape which projects out into the discharge port 9. An outer peripheral portion of an end portion of the pipe-shaped bypass path outlet portion is tapered so as to become narrow toward a distal end.

18 Claims, 5 Drawing Sheets

SCREW COMPRESSOR WITH A FLUID CONTRACTING BYPASS

BACKGROUND OF THE INVENTION

The present invention relates to a Lysholm compressor, and in particular, to a Lysholm compressor which preferably supplies compressed air to a fuel cell.

As a conventional Lysholm compressor, there is the screw type air compressor which is disclosed in Japanese Patent Application Laid-Open Publication No. H7-233730, shown in FIG. 11.

The screw type air compressor shown in FIG. 11 is, specifically, a Lysholm compressor for pressure charging for an engine. When a discharge pressure required of the compressor is low, a spool valve 101 is opened, and the air which is in the process of being compressed is bypassed from a tooth groove space 105 (which will be necessarily called a "rotor tooth groove space" hereinafter) of a rotor 103, via a bypass path 107 to a discharge port 109. When the discharge pressure required of the compressor is high, the spool valve 101 is closed, and the compressed air is prevented from flowing backward from the discharge port 109 via the bypass path 107 to the rotor tooth groove space 105. In this way, a high efficiency is obtained over a wide range of pressures.

Note that, in FIG. 11, reference numeral 111 denotes a housing in which the rotor 103 is provided, reference numeral 113 denotes a suction port, reference numeral 115 denotes sucked-in air which is sucked in from the suction port 113, and reference numeral 117 denotes discharged air (compressed air) which is discharged from the discharge port 109.

SUMMARY OF THE INVENTION

However, according to studies of the present inventor, in a case in which such a conventional Lysholm compressor is used for a fuel cell, and specifically, as a compressor for a fuel cell, the following situation may occur.

Namely, a range of pressures required of a compressor for a fuel cell is very wide, from low pressures to high pressures. In particular, with regard to pressures at the high pressure side, although a pressure-charging pressure for an engine is less than or equal to 80 kPaG, a pressure-charging pressure for a fuel cell is greater than or equal to 200 kPaG which is extremely high. Because the temperature of the compressed air at this time rises to a high temperature of greater than or equal to 200° C. at maximum, the compressor for a fuel cell is run in an extremely wide range of temperatures from low temperatures to high temperatures.

However, the spool valve 101 must be sealable. Therefore, the clearance between the spool valve 101 and the bypass path 107 is extremely narrow. Thus, in a case, such as that of a compressor for a fuel cell, in which the compressor is used in an extremely wide temperature range, it is easy for so-called biting-in to occur, i.e., it is easy for the spool valve 101 to catch on corresponding slide portions to scratch them. Thus, the reliability of the operation of the valve deteriorates.

Further, because there are cases in which the fuel cell is affected by oil, the spool valve 101 cannot be lubricated sufficiently by oil. Thus, the reliability of the operation of the valve deteriorates even more.

The present invention was done in consideration of the above-described studies, and an object of the present invention is to provide a Lysholm compressor for a fuel cell which can obtain high efficiency in a wide range of pressures from low pressures to high pressures and can carry out highly reliable operation, without using an additional valve element such as a spool valve or the like.

In order to achieve the above-mentioned object, a Lysholm compressor of the present invention is provided with: a rotor, in which a spiral tooth groove is formed in order to form a tooth groove space, taking-in and compressing a fluid in the tooth groove space; a discharge port which discharges the fluid compressed by the rotor; a bypass path which communicates the discharge port and the tooth groove space; and an outlet portion of the bypass path which faces the discharge port. Here, the outlet portion is a pipe shape which projects out into the discharge port, and an outer peripheral portion of an end portion of the pipe-shaped bypass path outlet portion is tapered so as to become more narrow toward a distal end thereof.

In other words, a Lysholm compressor of the present invention is provided with: a rotor, in which a spiral tooth groove is formed in order to form a tooth groove space, taking-in and compressing a fluid in the tooth groove space; a discharge port which discharges the fluid compressed by the rotor; a bypass path which communicates the discharge port and the tooth groove space; and acontracted flow forming means, which is provided at an outlet portion of the bypass path which faces the discharge port, and which forms a contracted flow of fluid which flows from the discharge port toward the tooth groove space in the bypass path.

Other and further features, advantages, and benefits of the present invention will become more apparent from the following description taken in conjunction with the following drawings.

DETAILED DESCRIPTION OF THE PREFERRED EMBODIMENT

Hereinafter, Lysholm compressors of respective embodiments of the present invention will be described in detail with appropriate reference to the drawings by using, as an example, a structure which is applied as a compressor which supplies compressed air in order to supply a gas including oxygen, which reacts with hydrogen, to a fuel cell.

First of all, a Lysholm compressor relating to a first embodiment of the present invention will be described in detail with reference to FIG. 1 to FIG. 3B.

Figure 1:
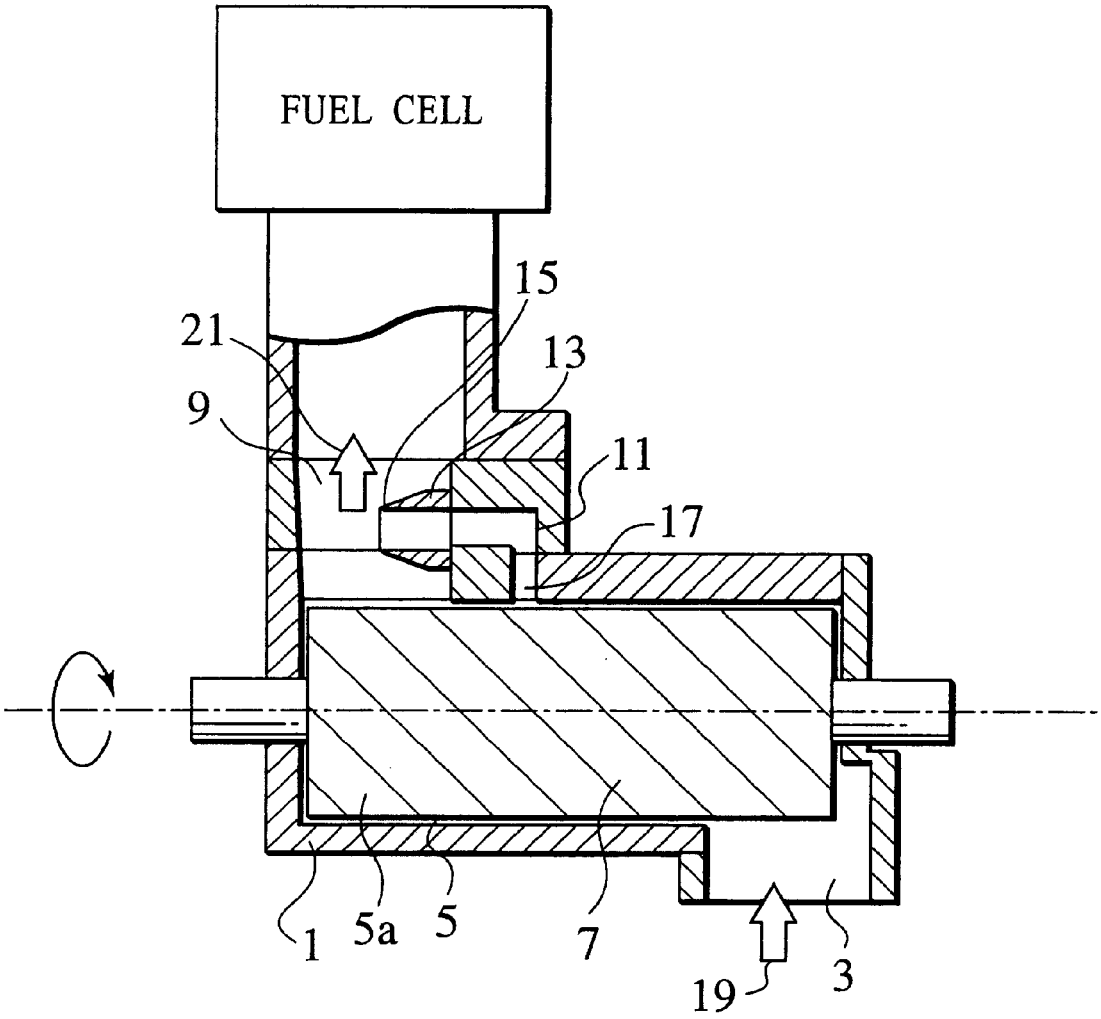
FIG. 1 is a partial sectional view which mainly shows a Lysholm compressor for a fuel cell according to a first embodiment of the present invention.

As shown in FIG. 1, in a casing 1 of the Lysholm compressor are provided a suction port 3 which sucks in air as a fluid, a rotor 5 in which a spiral tooth groove 5*a* is formed and which takes in and compresses air which has been sucked from the suction port 3 into a tooth groove space 7 which is a space formed between the tooth grooves, a discharge port 9 which discharges air compressed by the rotor 5, and a bypass path 11 which communicates the discharge port 9 and the tooth groove space 7 of the rotor 5.

A bypass path outlet portion 13 which faces the discharge port 9 is formed in a pipe shape which projects out into the discharge port 9. A taper which becomes narrow toward the distal end thereof, i.e., toward a bypass path 15, is attached to the outer peripheral portion of the end portion of the bypass path outlet portion 13.

On the other hand, a bypass path inlet 17 which faces the rotor tooth groove space 7 is merely a hole which opens in a plane. In the present embodiment, as shown in detail in FIG. 2, the bypass path inlet 17 is not chamfered.

In FIG. 1, as the rotor 5 rotates, air is sucked into the suction port 3 as intake air 19. After being compressed by the rotor 5, the air is discharged as compressed air 21 from the discharge port 9. At that time, in accordance with a discharge pressure required of the compressor, a part of the air in the tooth groove space 7 (air which is in the process of being compressed) is bypassed through the bypass path 11 to the discharge port 9.

Figure 3A:
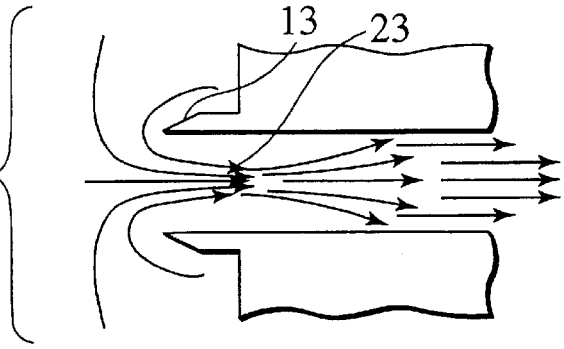
FIG. 3A is a schematic view of the flow of air in order to explain an effect based on the configuration of an outlet portion of the bypass path, and corresponds to a case in which the outlet portion of the bypass path has a tapered structure according to the embodiment.
Figure 3B:
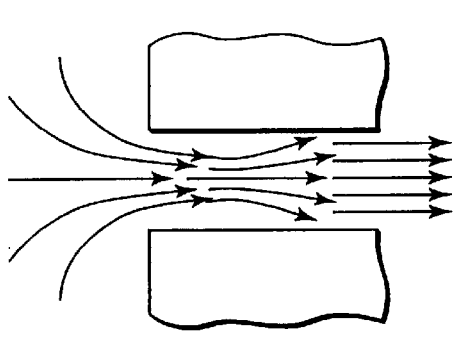
FIG. 3B is a schematic view and corresponds to a case in which the outlet portion of the bypass path has a perpendicular hole which merely opens in a plane.

Next, with reference to the structural views of the flow of air shown in FIGS. 3A and 3B, effects based on the configuration of the bypass path outlet portion 13 will be described. FIG. 3A is a structural view of the flow of air in a case in which the bypass path outlet portion 13 is formed in a tapered pipe shape. FIG. 3B is a structural view of the flow of air in a case in which the bypass path outlet portion is a perpendicular hole form which merely opens in a plane, for comparison with FIG. 3A.

First, in a case in which a discharge pressure of the compressor, i.e., the pressure in the discharge port 9, is lower than the pressure in the tooth groove space 7, air which is in the process of being compressed flows through the bypass path 11 into the discharge port 9 in which the pressure is low. Therefore, further compression is not carried out. Thus, a high efficiency is obtained at a low discharge pressure.

On the other hand, in a case in which a discharge pressure of the compressor, i.e., the pressure in the discharge port 9, is higher than a pressure in the tooth groove space 7, the compressed air in the discharge port 9 attempts to flow backward toward the tooth groove space 7 where the pressure is low. However, the bypass path outlet portion 13 which faces the discharge port 9 is a pipe form which is tapered to become narrow toward the distal end thereof. Namely, in a case in which the bypass path outlet portion 13 has such a tapered pipe configuration, as shown in FIG. 3A, a so-called contracted flow 23 develops (a phenomenon in which the sectional area of the flow is reduced) and the pressure loss becomes extremely high, as opposed to the flow of air in the case of the perpendicular hole form shown in FIG. 3B. Therefore, it is difficult for the air, which flows backward from the discharge port 9 toward the bypass path 11, to flow as a result of the contracted flow 23 developing in a vicinity of the bypass path outlet portion 13.

Namely, in this case, the pressure loss in the case in which air flows backward from the discharge port 9 to the tooth groove space 7 is very much greater than the case in which air flows from the tooth groove space 7 to the discharge port 9. Therefore, the backward flow from the discharge port 9 to the tooth groove space 7 is suppressed, and an effect which is just as if the bypass path 11 was closed by a valve is obtained. In other words, even when the discharge pressure of the compressor is high, high efficiency can be obtained with a simple structure.

As described above, in the structure of the present embodiment, the bypass path outlet portion 13 which faces the discharge port 9 is a pipe shape which projects out into the discharge port 9, and the taper portion which becomes narrow toward the distal end thereof is provided at the outer peripheral portion of the end portion of the pipe-formed bypass path outlet portion 13. Therefore, air which bypasses from the tooth groove space 7 via the bypass path 11 to the discharge port 9 flows easily, and it is difficult for air, which flows backward from the discharge port 9 via the bypass path 11 to the tooth groove space 7, to flow.

Therefore, without adding a valve element such as a spool valve or the like, high efficiency can be obtained in a wide range of pressures from low pressures to high pressures.

Because there is no valve element, even if the the Lysholm of compressor is used for that of a fuel cell in which an oil is not substantially used with a wide range of temperatures from low temperature to high temperature, high reliability can be obtained.

Further because there is no valve element, no switching sound of a valve is generated such that a low noise level can be achieved. Further, costs can be reduced, and the structure can be made more compact and lightweight. Moreover, an improvement in maintainability can also be achieved.

Next, a Lysholm compressor for a fuel cell relating to a second embodiment of the present invention will be described in detail with reference to FIGS. 4 and 5. Note that the present embodiment has a basic structure which is the same as that of the Lysholm compressor for a fuel cell which corresponds to the first embodiment shown in FIG. 1. The same structural elements are denoted by the same reference numerals, and description thereof will be appropriately simplified or omitted.

Figure 4:
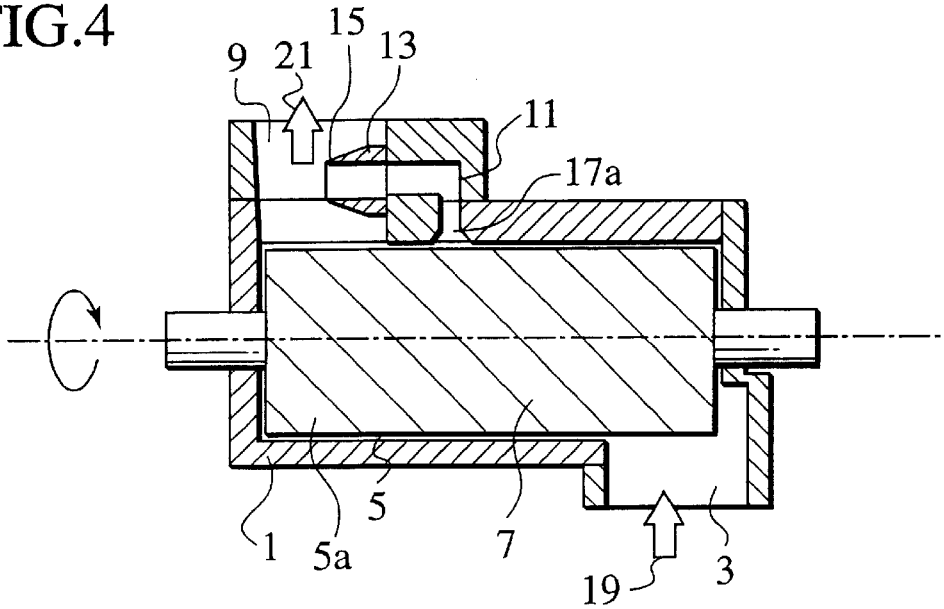
FIG. 4 is a sectional view which shows a Lysholm compressor according to a second embodiment of the present invention.
Figure 5:
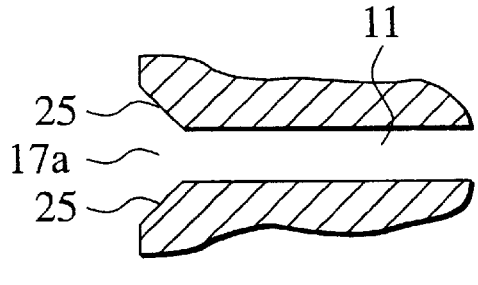
FIG. 5 is an enlarged sectional view of a bypass path inlet of the Lysholm compressor according to the embodiment.

As shown in FIGS. 4 and 5, the present embodiment differs from the structure of the first embodiment in that a bypass path inlet 17*a* which faces the tooth groove space 7 is chamfered in a tapered form, i.e., a tapered portion 25 is formed, such that, the further toward the interior of the bypass path 11, the smaller the sectional area of the path.

Figure 2:
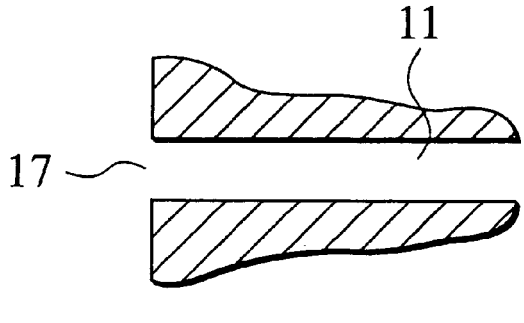
FIG. 2 is an enlarged sectional view of a bypass path inlet of the Lysholm compressor according to the embodiment.

In this way, in the case in which the bypass path inlet 17*a* is chamfered in a tapered form, the pressure loss coefficient is reduced by about ½ as compared with a case of a configuration which is not chamfered which corresponds to the first embodiment shown in FIG. 2. Therefore, it is even easier for the air in the tooth groove space 7 to be bypassed through the bypass path 11 to the discharge port 9.

As a result, in the present embodiment, in addition to the effects relating to the first embodiment, the efficiency particular at a time of low discharge pressure operation can be improved even more due to the bypass path inlet 17*a* being chamfered in a tapered form which becomes more narrow toward the interior thereof.

Next, a Lysholm compressor relating to a third embodiment of the present invention will be described in detail with reference to FIGS. 6 and 7. Note that the present embodiment has a basic structure which is the same as that of the Lysholm compressor for a fuel cell which corresponds to the first embodiment shown in FIG. 1. The same structural elements are denoted by the same reference numerals, and description thereof will be appropriately simplified or omitted.

Figure 6:
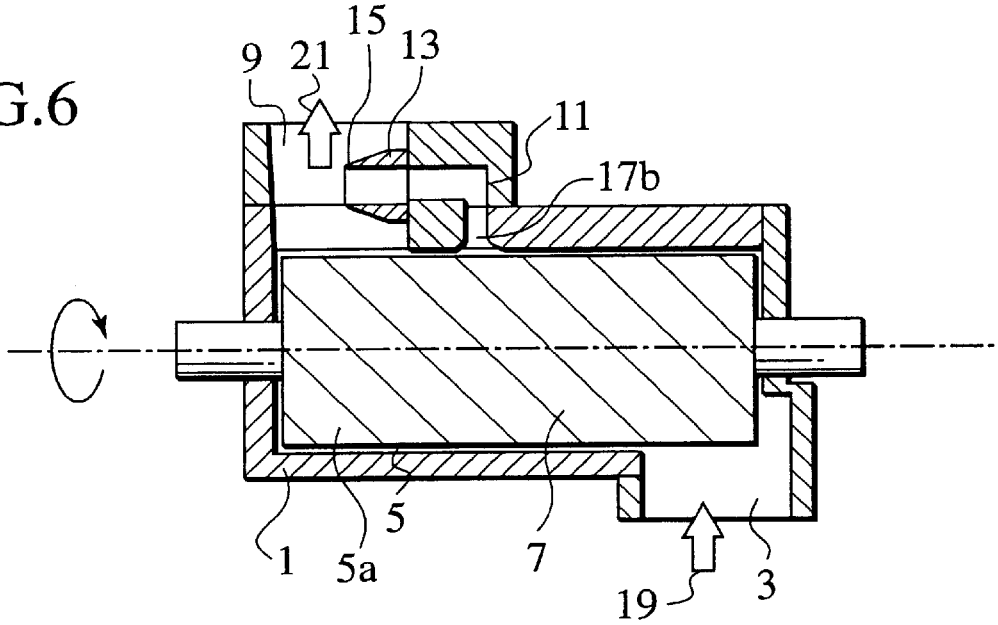
FIG. 6 is a sectional view which shows a Lysholm compressor according to a third embodiment of the present invention.
Figure 7:
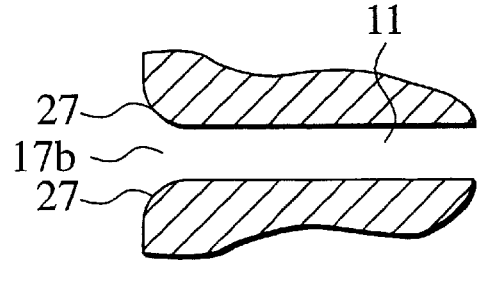
FIG. 7 is an enlarged sectional view of a bypass path inlet of the Lysholm compressor according to the embodiment.

The present embodiment differs from the structure of the first embodiment in that, as shown in FIGS. 6 and 7, a bypass path inlet 17*b* which faces the tooth groove space 7 is formed in a so-called bell-mouth shape so as to form a bell-mouth portion 27. The sectional area of the path becomes more narrow toward the interior of the bypass path In this way, in the case in which the bypass path inlet 17*b* is formed in a bell-mouth form, the pressure loss coefficient is reduced to about 1/10 to 1/100 as compared with a case of a form which is not chamfered which corresponds to the first embodiment shown in FIG. 2. Therefore, as compared with the first embodiment and even with the second embodiment, it is even easier for the air in the tooth groove space 7 to be bypassed through the bypass path 11 to the discharge port 9.

As a result, in the present embodiment, in addition to the effects relating to the first embodiment, the efficiency particularly at the time of low discharge pressure operation can be improved even more due to the bypass path inlet 17*b* being formed in a bell-mouth shape which becomes more narrow toward the interior thereof.

Next, a Lysholm compressor for fuel cell relating to a fourth embodiment of the present invention will be described in detail with reference to FIG. 8. Note that the present embodiment has a basic structure which is the same as that of the Lysholm compressor for a fuel cell which corresponds to the first embodiment shown in FIG. 1. The same structural elements are denoted by the same reference numerals, and description thereof will be appropriately simplified or omitted.

Figure 8:
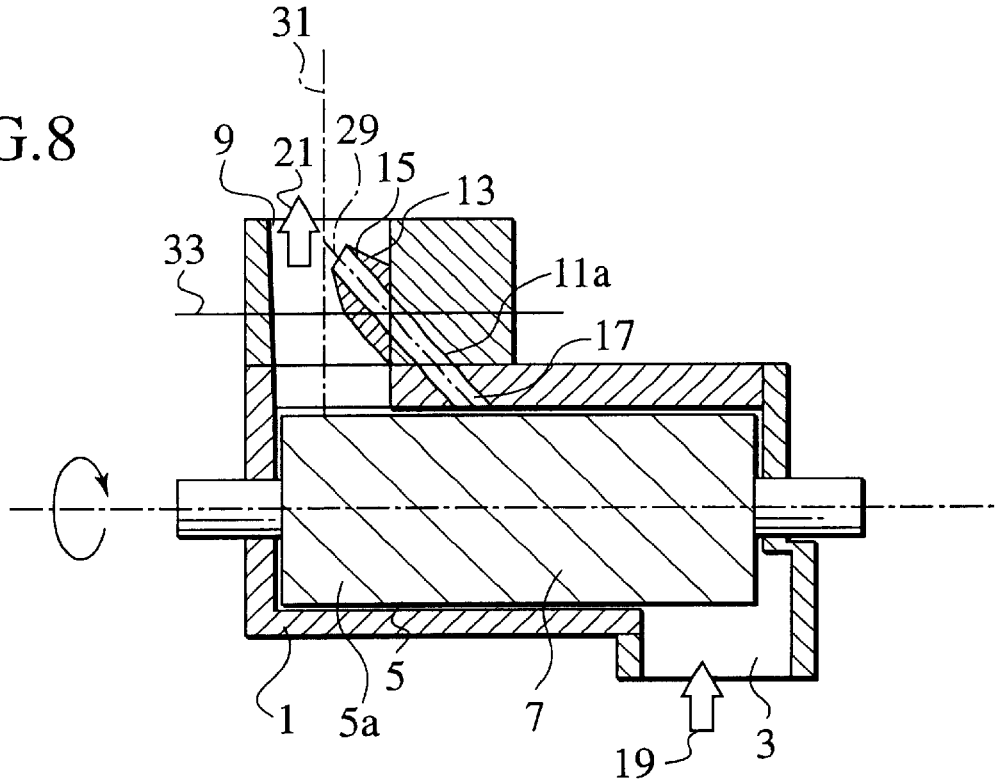
FIG. 8 is a sectional view which shows a Lysholm compressor for a fuel cell relating to a fourth embodiment of the present invention.

In the present embodiment, as shown in FIG. 8, a bypass path 11*a* is tilted, i.e., a bypass path center line 29 in a vicinity of the bypass path outlet portion 15 is tilted toward a downstream side of the discharge port 9 with respect to a perpendicular plane 33 which is perpendicular to a discharge port center line 31.

In this way, in the case in which the bypass path 11*a* is tilted, the outlet 15 of the bypass path 11*a* is open at an incline toward the downstream direction of the flow of the compressed air in the discharge port 9. Therefore, it is easy for the air, which is bypassed toward the discharge port 9 from the bypass path 11*a,* to flow. On the other hand, with regard to the direction of air flow from the discharge port 9 to the bypass path 11*a* if it does not turn rapidly, i.e., at an acute angle. Therefore, it is difficult for the air which flows backward in the bypass path 11*a* to flow.

As a result, in the present embodiment, in addition to the effects relating to the first embodiment, the efficiency at. the time of high discharge pressure operation can be improved even more due to the bypass path center line 29 in a vicinity of the bypass path outlet portion 13 being tilted toward the downstream side of the discharge port 9 with respect to the perpendicular plane 33 which is perpendicular to the discharge port center line 31, and the outlet 15 of the bypass path 11*a* being open at an incline toward the downstream direction of the flow of compressed air in the discharge port 9.

Next, a Lysholm compressor for a fuel cell relating to a fifth embodiment of the present invention will be described in detail with reference to FIG. 9. Note that the present embodiment has a basic structure which is the same as that of the Lysholm compressor for a fuel cell which corresponds to the fourth embodiment shown in FIG. 8. The same structural elements are denoted by the same reference numerals, and description thereof will be appropriately simplified or omitted.

Figure 9:
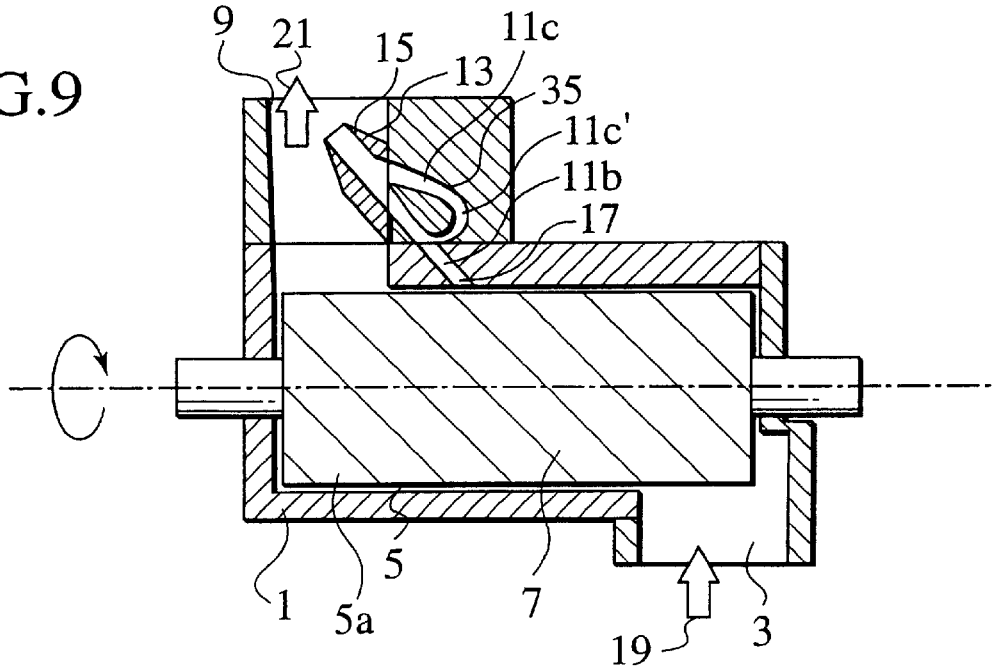
FIG. 9 is a sectional view which shows a Lysholm compressor according to a fifth embodiment of the present invention.

In the present embodiment, as shown in FIG. 9, a so-called fluid diode 35 (a flow path structure having the form of a flow path which is highly resistant to back flow of a fluid), which has the characteristic that flow from the tooth groove space 7 to the discharge port 9 is easy and flow from the discharge port 9 to the tooth groove space 7 is difficult, is provided at an inner portion of a bypass path 11*b*. This fluid diode 35 has a branched-off path 11*c* which is formed by being branched off from the bypass path 11*b*. Concretely, the branched off path 11*c* has a return portion 11*c*' wherein, at the time that the fluid flows backward in the bypass path 11*b,* when a portion of the fluid flows into the return portion 11*c*', the return portion 11*c*' returns the direction of flow to a direction toward the bypass path outlet portion 13.

In this way, in a case in which the fluid diode 35 is provided, it is even more difficult for the back flow from the discharge port 9 to the tooth groove space 7 to arise.

As a result, in the present embodiment, in addition to the effects relating to the fourth embodiment, efficiency at the time of a high discharge pressure operation can be improved even more due to providing, at the interior of the bypass path 11*b,* the fluid diode 35 which has the characteristic that flow from the tooth groove space 7 to the discharge port 9 is easy, and flow from the discharge port 9 to the tooth groove space 7 is difficult.

Note that, the present embodiment was described on the basis of the structure of the fourth embodiment. However, the present embodiment may of course be applied to other embodiments including a sixth embodiment which will be described hereinafter.

Next, a Lysholm compressor for a fuel cell relating to the sixth embodiment of the present invention will be described in detail with reference to FIG. 10. Note that the present embodiment has a basic structure which is the same as that of the Lysholm compressor for a fuel cell which corresponds to the first embodiment shown in FIG. 1. The same structural elements are denoted by the same reference numerals, and description thereof will be appropriately simplified or omitted.

Figure 10:
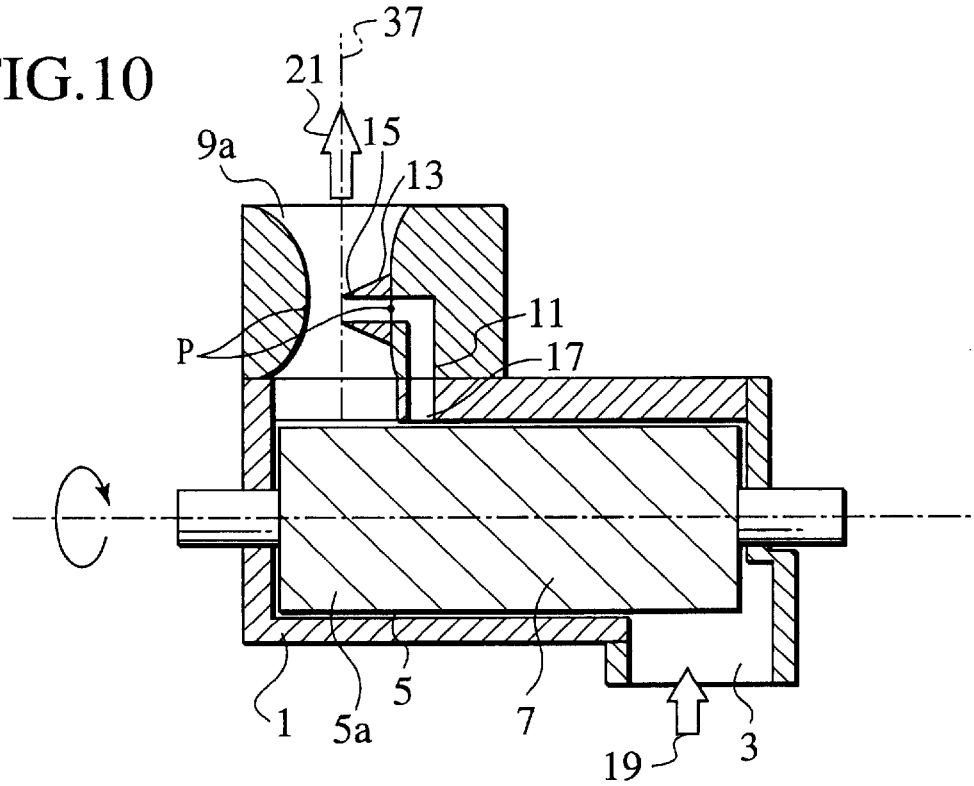
FIG. 10 is a sectional view which shows a Lysholm compressor according to a sixth embodiment of the present invention.
Figure 11:
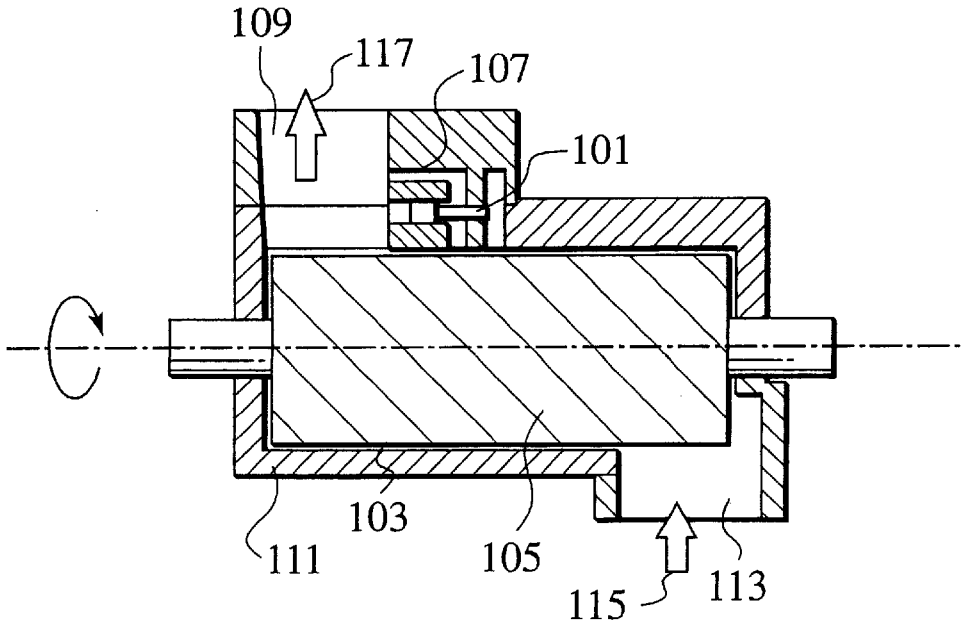
FIG.11 PRIOR ART
FIG. 11 is a sectional view which shows a conventional Lysholm compressor.

As shown in FIG. 10, the feature of the sixth embodiment is that the sectional area of a discharge port 9*a* in a plane perpendicular to a discharge port center line 37 is minimum at a position P which corresponds to the outlet 15 of the bypass path 11, and gradually increases from the position P of the outlet 15 of the bypass path 11 toward the upstream side and the downstream side of the flow of the compressed air.

In this case in which the sectional area in the discharge port 9*a* is varied, the flow rate of the compressed air which flows in the discharge port 9*a* is a maximum in the vicinity of the bypass path outlet 15. Therefore, the static pressure is a minimum in the vicinity of the bypass path outlet 15. Thus, in a case in which the discharge pressure of the discharge port 9*a* is relatively low, the air in the tooth groove space 7 is actively bypassed to the discharge port 9*a*. In a case in which the discharge pressure of the discharge port 9*a* is relatively high, it is difficult for the air in the discharge port 9*a* to flow backward to the tooth groove space 7.

As a result, in the present embodiment, in addition to the effects relating to the first embodiment, even higher efficiency can be obtained in the entire pressure range from low pressures to high pressures, due to the sectional area in a plane perpendicular to the discharge port center line 37 in the discharge port 9*a* being a minimum at the position of the outlet 15 of the bypass path 11, and gradually increasing from the position of the outlet 15 of the bypass path 11 toward the upstream side and the downstream side of the flow of compressed air.

Although the invention has been described above by reference to certain embodiments of the invention, the invention is not limited to the embodiments described above. Modifications and variations of the embodiments described above will occur to those skilled in the art, in light of the teachings. The scope of the invention is defined with reference to the following claims.

What is claimed is:

1. A Lysholm compressor comprising:

a rotor in which a spiral tooth groove is formed in order to form a tooth groove space, the rotor taking a fluid thereinto and compressing the fluid in the tooth groove space;

a discharge port discharging the fluid compressed by the rotor;

a bypass path in fluid communication with the discharge port and the tooth groove space; and an outlet portion of the bypass path, the outlet portion projecting out into the discharge port, an outer peripheral portion of an end portion of the outlet portion having a tapered portion becoming more narrow toward a distal end thereof.

2. A Lysholm compressor according to claim 1, wherein the Lysholm compressor delivers the compressed fluid to a fuel cell.

3. A Lysholm compressor according to claim 1, wherein an inlet of the bypass path facing the tooth groove space is chamfered in a tapered form to become more narrow toward an inner portion of the bypass path.

4. A Lysholm compressor according to claim 1, wherein an inlet of the bypass path facing the tooth groove space is formed in a bell-mouth shape to become more narrow toward an inner portion of the bypass path.

5. A Lysholm compressor according to claim 1, wherein a center line of the outlet portion of the bypass path is tilted toward a downstream side of the discharge port with respect to a plane perpendicular to a center line of the discharge port.

6. A Lysholm compressor according to claim 1, wherein the bypass path has a fluid diode structure such that the fluid is easily flowed from the tooth groove space to the discharge port, and the fluid is with difficulty flowed from the discharge port to the tooth groove space.

7. A Lysholm compressor according to claim 1, wherein a sectional area of the discharge port in a plane perpendicular to a center line of the discharge port is a minimum at the outlet portion of the bypass path, and gradually increases from the outlet portion toward an upstream side and a downstream side of the discharge port.

8. A Lysholm compressor according to claim 1, wherein the outer peripheral portion of the end portion of the outlet portion further has a straight portion adjacently formed to the tapered portion.

9. A Lysholm compressor according to claim 1, wherein the outlet portion of the bypass path is configured such that the bypass path extends substantially into the discharge port.

10. A Lysholm compressor according to claim 9, wherein the outlet portion of the bypass path is configured such that the bypass path extends about ⅓ to about ½ of the distance across the discharge port.

11. A Lysholm compressor according to claim 9, wherein the Lysholm compressor delivers the compressed fluid to a fuel cell.

12. A Lysholm compressor according to claim 9, wherein an inlet of the bypass path facing the tooth groove space is chamfered in a tapered form to become more narrow toward an inner portion of the bypass path.

13. A Lysholm compressor according to claim 9, wherein an inlet of the bypass path facing the tooth groove space is formed in a bell-mouth shape to become more narrow toward an inner portion of the bypass path.

14. A Lysholm compressor according to claim 9, wherein a center line of the outlet portion of the bypass path is tilted toward a downstream side of the discharge port with respect to a plane perpendicular to a center line of the discharge port.

15. A Lysholm compressor according to claim 9, wherein the bypass path has a fluid diode structure such that the fluid flows more easily from the tooth groove space to the discharge port as compared to flow from the discharge port to the tooth groove space.

16. A Lysholm compressor according to claim 9, wherein a sectional area of the discharge port in a plane perpendicular to a center line of the discharge port is a minimum at the outlet portion of the bypass path, and gradually increases from the outlet portion toward an upstream side and a downstream side of the discharge port.

17. A Lysholm compressor according to claim 9, wherein the outer peripheral portion of the end portion of the outlet portion further has a straight portion adjacently formed to the tapered portion.

18. A Lysholm compressor comprising:

a rotor in which a spiral tooth groove is formed in order to form a tooth groove space, the rotor taking a fluid thereinto and compressing the fluid in the tooth groove space;

a discharge port discharging the fluid compressed by the rotor;

a bypass path communicating the discharge port and the tooth groove space; and a contracted flow forming means, provided at an outlet portion of the bypass path facing the discharge port, for forming a contracted flow of the fluid flowing from the discharge port toward the tooth groove space in the bypass path.

* * * * *